United States Patent [19]

Dart et al.

[11] 4,412,629

[45] Nov. 1, 1983

[54] NON-SPILL DRINK-THROUGH LID

[75] Inventors: William A. Dart; Kenneth B. Dart, both of Okemos, Mich.

[73] Assignee: Dart Container Corporation, Mason, Mich.

[21] Appl. No.: 317,789

[22] Filed: Nov. 4, 1981

[51] Int. Cl.[3] ..... A47G 19/22

[52] U.S. Cl. ..... 220/90.4; 220/254; 229/7 R

[58] Field of Search ..... 220/90.2, 90.4, 254; 229/7 R

[56] References Cited

U.S. PATENT DOCUMENTS

| | | | |
|---|---|---|---|
| 3,797,696 | 3/1974 | Dirbell | 220/90.4 |
| 3,927,794 | 12/1975 | Erdman | 220/268 |
| 4,056,210 | 11/1977 | Boyle | 220/904 |
| 4,106,660 | 8/1978 | Boyle . | |
| 4,113,135 | 10/1978 | Yamazaki | 220/268 |
| 4,138,033 | 2/1979 | Payne | 220/90.4 |
| 4,184,604 | 1/1980 | Amberg | 220/90.4 |
| 4,190,174 | 2/1980 | Haimowitz | 220/90.4 |
| 4,210,256 | 7/1980 | Amberg et al. | 220/90.4 |
| 4,245,752 | 1/1981 | Prueher | 220/90.4 |

*Primary Examiner*—George E. Lowrance

*Attorney, Agent, or Firm*—Miller, Morriss & Pappas

[57] ABSTRACT

A non-spill drink-through lid for use on a drinking cup having a depressible tab portion defined therein which is selectively depressible to provide a drink-through opening in the lid and which is biased to return to its normally closed position within the plane of the lid upon removal of lip pressure thereagainst. A raised hollow lip-engaging buttress member is integrally formed in the tab portion. The buttress member is configured to provide increased heat dissipating surfaces thereon so as to insulatively engage the upper lip of a user drinking from the cup through the drinking opening in the lid. A downwardly depending outwardly curved elongate annular skirt portion is provided on the lid which is configured to make sealing insulative engagement with the lower lip of the user drinking therefrom so as to prevent spillage and to avoid contact of the user's lower lip with the cup itself.

3 Claims, 14 Drawing Figures

NON-SPILL DRINK-THROUGH LID

This invention relates to a non-spill drink-through lid for use on a drinking cup. More specifically, the lid is provided with a tab portion defined in the lid which is selectively depressible so as to provide a drinking opening through the lid. The tab portion is biased to return to its normally closed position within the plane of the lid upon removal of the lip pressure thereagainst. A raised hollow lip-engaging buttress member is integrally formed in the tab portion. The hollow buttress member is configured to provide increased heat dissipating surfaces thereon so as to insulatively engage the upper lip of a user drinking from the cup through the drinking opening in the lid. In use, the upper lip of the user engages the buttress member so as to selectively depress the tab portion thereby providing a drinking or sipping opening through the lid.

In the preferred embodiment of the invention, the hollow lip-engaging buttress member has a corrugated configuration which comprises a plurality of ridges having grooves therebetween which provide increased heat dissipating surfaces thereon so as to insulatively engage the upper lip of the user drinking therefrom so that the upper lip is not burned or scalded by the heat of the liquid in the cup. The raised hollow buttress portion can be selectively configured to extend over the imaginary bend line of the tab portion onto the main body of the lid so as to enhance the biasing of the tab portion back into its normally closed position within the plane established by the rest of the horizontal portion of the lid.

The lid is also provided with a downwardly depending outwardly curved elongate annular skirt portion which is configured to make sealing engagement with the lower lip of the user drinking therefrom so as to prevent spillage and to prevent contact of the user's lower lip with the cup itself.

While there are other prior art lid devices which have drink-through capabilities, none of the lids of the prior art are provided with a downwardly depressible tab portion having a hollow raised lip-engaging corrugated buttress member which acts to insulatively engage a user's upper lip pressed thereagainst and which also selectively acts to bias the tab portion back into its normally closed horizontal position within the plane of the horizontal portion of the lid when lip pressure is removed therefrom. Further, none of the prior art lids are provided with a downwardly depending outwardly curved elongate annular skirt portion which is configured to make full sealing engagement with the lower lip of the person drinking therefrom so as to prevent spillage and to prevent contact of the user's lip with the cup itself.

It is therefore an object of this invention to provide a non-spill drink-through lid for use with a drinking cup and which permits the user to drink from the cup without removing the lid therefrom.

Another object of this invention is to provide a non-spill drink-through lid having a tab portion defined in the central portion of the lid which is selectively depressible so as to provide a drink-through opening in the lid.

Yet another object of this invention is to provide a non-spill drink-through lid having a tab portion which is provided with a raised lip-engaging hollow buttress member integrally formed therein.

Another object of this invention is to provide a non-spill drink-through lid wherein the lip-engaging hollow buttress member is configured to provide increased heat dissipating surfaces thereon so as to insulatively engage the upper lip of a user drinking from the cup upon which the lid is mounted.

Another object of this invention is to provide a non-spill drink-through lid provided with a lip-engaging hollow buttress member having a corrugated configuration so as to provide increased heat-dissipating surfaces thereon so as to insulatively engage the upper lip of a user drinking from the cup upon which the lid is mounted.

A still further object of this invention is to provide a non-spill drink-through lid wherein the lip-engaging hollow corrugated buttress member which is integrally formed in the tab portion defined in the lid selectively extends toward the center of the lid across the bend line of the tab portion so as to selectively bias the tab portion back to its normally closed position within the plane of the lid.

Another object of this invention is to provide a non-spill drink-through lid having a downwardly depending outwardly curved elongate annular skirt which is configured to make full sealing engagement with the lower lip of the person drinking therefrom so as to prevent spillage and to prevent contact of the person's lower lip with the cup itself.

Other objects and advantages found in the construction of the invention will be apparent from a consideration of the following specification in connection with the appended claims and the accompanying drawings.

DESCRIPTION

Figure 1:
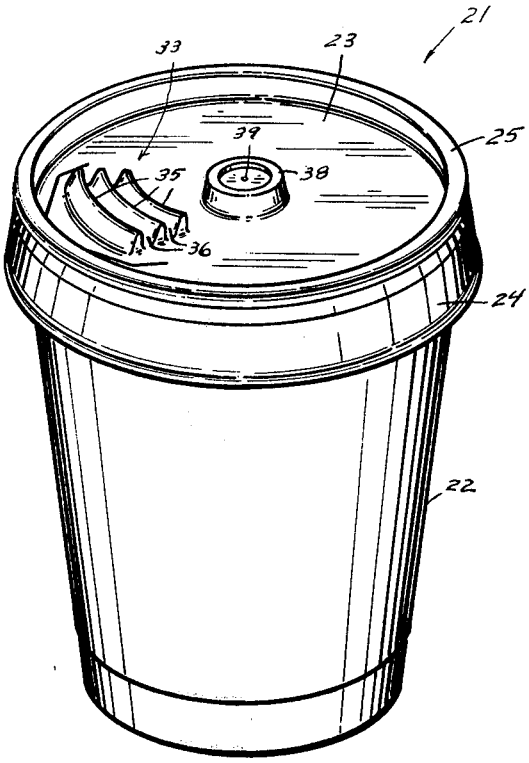
FIG. 1 is a perspective view of the non-spill drink-through lid in its operative use position on a drinking cup and showing the lip-engaging corrugated buttress member integrally provided on the tab portion of the lid.

As shown generally in the drawings and more specifically in FIG. 1, a non-spill drink-through lid 21 which is adapted for selective use upon a drinking container or cup 22 of a type that is well known in the prior art. Although the preferred embodiment of the lid 21 is fabricated from a thin sheet of plastic material, it is within the scope of the invention that the lid 21 can selectively be fabricated from paper products or other suitable composite material. Similarly, the cup 22 can be of the insulating type formed by foamable plastic material or can be fabricated from paper or other suitable composite material. It should be also noted that the cup 22 can be of any standard type known in the art and is not considered to be a part of this invention.

Figure 6:
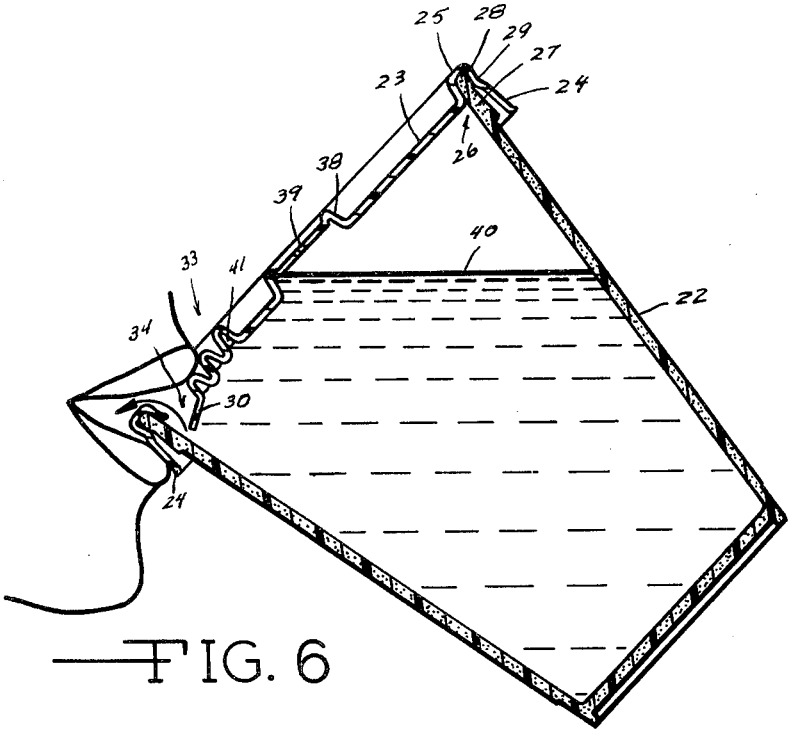
FIG. 6 is a cross-sectional schematic view showing the non-spill drink-through lid in its operative drinking use position.
Figure 9:
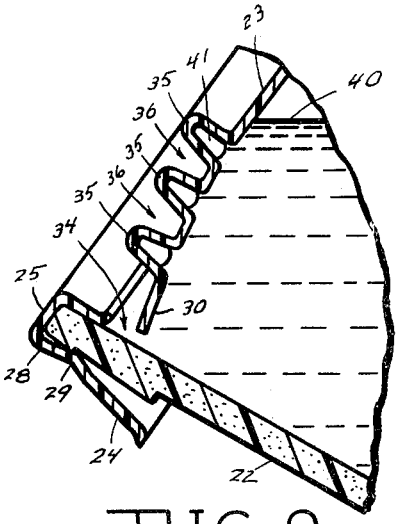
FIG. 9 is an enlarged partial cross-sectional view of the non-spill drink-through lid in its operative use position on a drinking cup with the drinking tab in its depressed open position.
Figure 10:
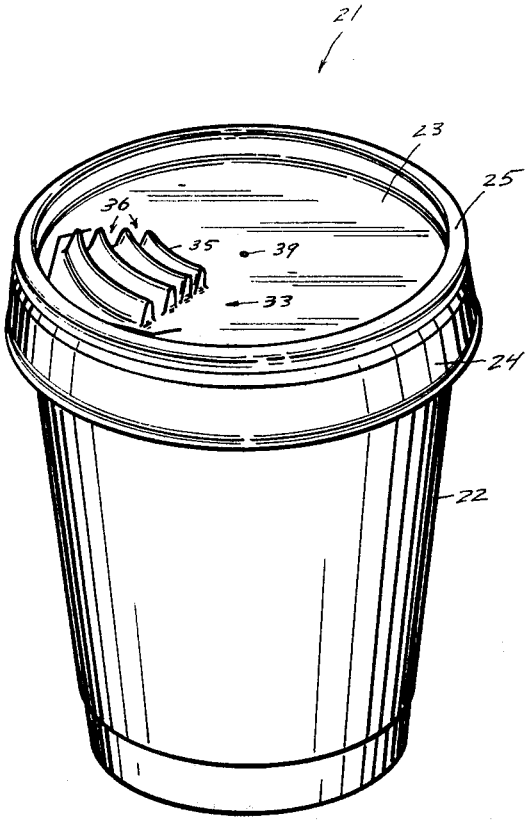
FIG. 10 is a perspective view of a modified embodiment of the non-spill drink-through lid.
Figure 11:
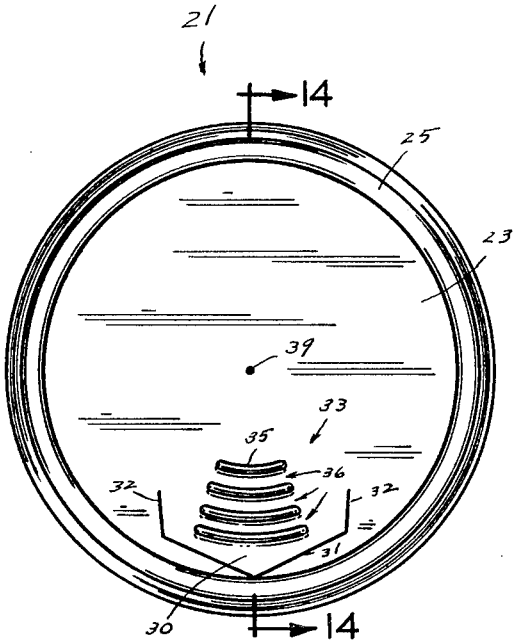
FIG. 11 is a top view of the modified embodiment of the non-spill drink-through lid shown in FIG. 10.
Figure 12:
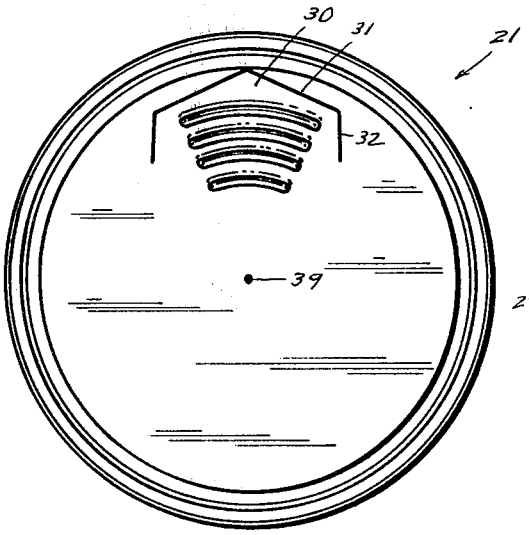
FIG. 12 is a bottom view of the modified embodiment of the non-spill drink-through lid shown in FIG. 10.
Figure 13:
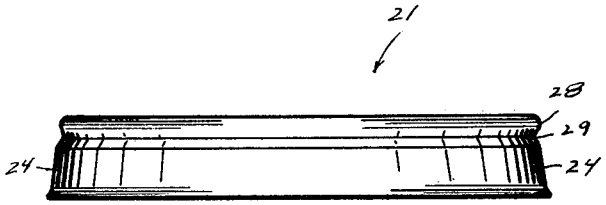
FIG. 13 is a side elevational view of the modified embodiment of the non-spill drink-through lid shown in FIG. 10.

The lid 21 is circular in shape and consists of a central cover portion 23 and an elongate downwardly depending outwardly curved annular skirt 24. An upwardly extending annular ridge 25 is provided which defines an internal annular groove cavity 26 which is configured to snapably retainably engage the upper peripheral edge 27 of the cup 22 upon which the lid 21 is mounted. As shown in FIGS. 6 and 9, the outer vertical peripheral side 28 of the ridge 25 is inwardly curved at 29 so as to enhance snap-retention of the upper peripheral edge of a cup inserted within the groove cavity 26. The lower edge of the outer peripheral side 28 merges into the downwardly depending outwardly extending elongate annular skirt 29.

It should be noted that it is also within the scope of the invention that the central portion 23 of the lid 21 be extended to the outer peripheral edge of the lid 21 so as to merge directly with the downwardly depending skirt portion 24 thereby eliminating the annular ridge 25. In this configuration, the upper annular portion of the skirt 24 would be inwardly curved as at 29 so as to make snap-engagement with the outer surface of edge 27 of the cup 22.

The annular skirt 24 has a downwardly extending elongate configuration so as to make selective sealing engagement with the lower lip of the user drinking therefrom so as to prevent spillage and to prevent contact of the user's lower lip with the cup itself, thus avoiding scalding or burning of the user's lip by the hot cup wall in the event that a paper or metal cup is being used in connection with the lid. It should be noted that, while lids of the prior art do have annular skirt portions, such annular skirt portions do not have an elongate downwardly depending configuration which prevents contact of the user's lower lip with the side of the cup as does the elongate annular skirt of applicant's lid.

The foregoing insulative engagement of the user's lower lip with the elongate annular skirt 24 is shown in FIG. 6.

Figure 2:
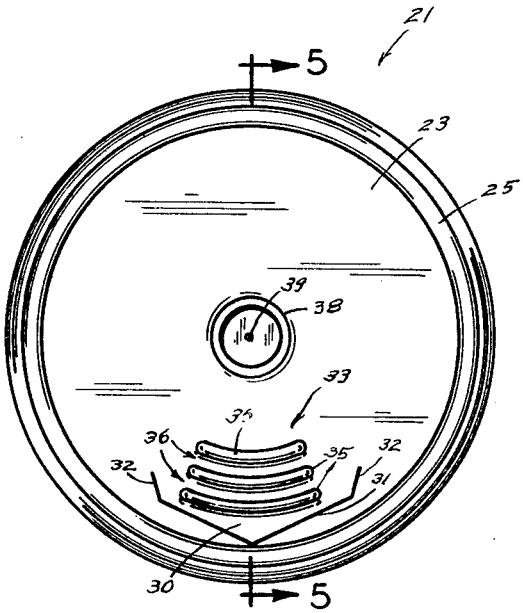
FIG. 2 is a top view of the non-spill drink-through lid.
Figure 3:
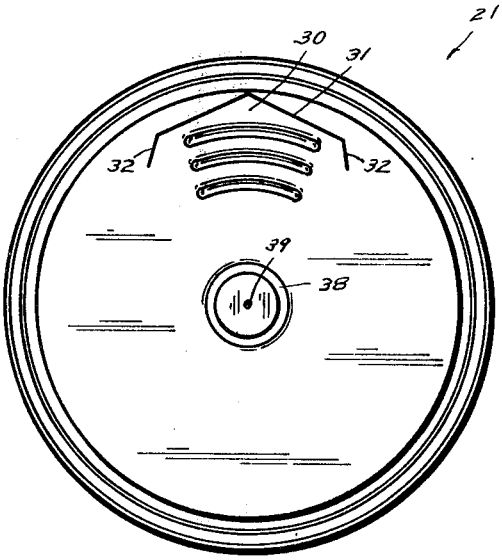
FIG. 3 is a bottom view of the non-spill drink-through lid.
Figure 4:
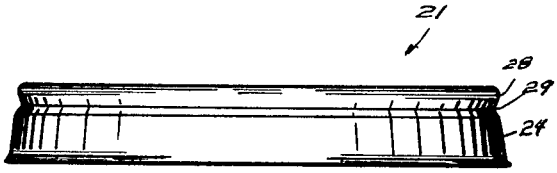
FIG. 4 is a side elevational view of the non-spill drink-through lid.
Figure 8:
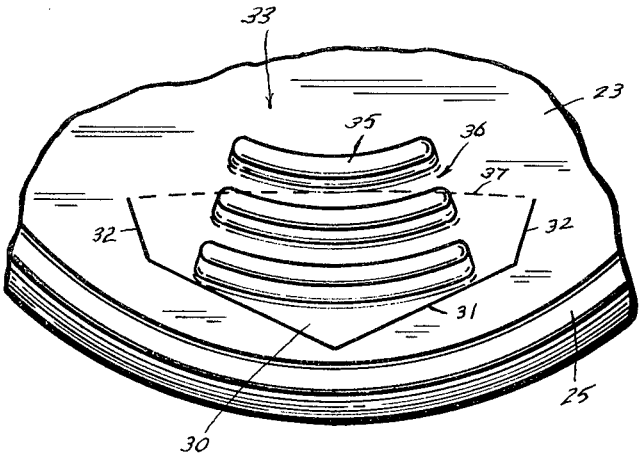
FIG. 8 is an enlarged partial top view of the non-spill drink-through lid showing the lip-engaging corrugated buttress member integrally provided on the tab portion of the lid.

As shown generally in the drawings and more specifically in FIGS. 2, 3 and 8, tab portion 30 is formed in the central cover portion 23. The tab portion 30 is formed by a substantially U-shaped slit or line of weakened cross-section 31 in or through the cover. The U-shaped slit 31 is provided with outwardly diverging legs 32 which extend inwardly toward the center of the lid.

A lip-engaging hollow buttress member 33 having a corrugated cross-sectional configuration is integrally formed in the tab portion 30.

Figure 7:
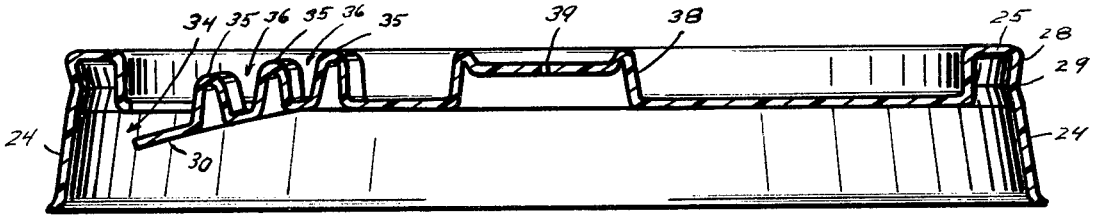
FIG. 7 is an enlarged schematic cross-sectional view of the non-spill drink-through lid showing the drinking tab portion in its downwardly depressed open position so as to provide a drinking opening in the lid.

As will be hereinafter described in greater detail, the upper lip of the user engages and selectively exerts pressure against the buttress member 33 so as to depress the tab portion 30 inwardly so as to provide a drinking opening 34 in the lid 21 as shown in FIGS. 6, 7, and 9.

In the preferred embodiment of the invention, the corrugated buttress member 33 is comprised of a plurality of arcuate parallel spaced-apart ridges 35 and corresponding arcuate grooves 36 positioned therebetween. The ridges 35 and grooves 36 are individually transversely longitudinally oriented on the tab 30 but in relation to each other they radiate concentrically inwardly toward the center of the lid 21. It is however within the scope of the invention that the buttress member 33 have a corrugated configuration wherein the ridges 35 and corresponding grooves 36 are substantially longitudinally radially-oriented on the tab 30 instead of transversely oriented in a concentric manner as shown in the drawings. Further, it is also within the scope of the invention that the buttress member 33 have a hollow waffle-type configuration or any other type of configuration such as hollow vanes or fingers that present increased heat-dissipating surface areas on the buttress member 33 so as to enhance the heat dissipating capability thereof. Thus configured, the buttress portion 33 makes insulative contact with the upper lip of the user, thereby protecting the user's lip from burning or scalding due to hot liquid bearing against the bottom surface of the lid during the drinking operation. In some instances, air is trapped within the grooves or pockets formed on the bottom surface of the buttress member due to the various configurations thereof thereby increasing the insulative capabilities thereof.

As shown in FIG. 8, the corrugated buttress member 33 can selectively extend inwardly toward the center of the lid across the bend line 37 of the tab portion 30 onto the inner horizontal portion of the central cover portion 23 of the lid 21. The imaginary bend line 37 is established generally as shown by a line drawn through the ends of the legs 32 of U-shaped slit 31. Thus positioned, the corrugated buttress member 33 acts to normally bias the depressed tab portion 30 back up into its normally closed position within the plane of the central cover portion 23 of the lid 21 when the pressure of the user's upper lip thereagainst is removed.

In the embodiment of the invention shown in FIGS. 1 through 9, a central raised pedestal member 38 is integrally formed in the center of the central portion 23 of the lid 21. A vent hole 39 is provided to facilitate the flow of liquid through the opening 34 formed as the tab portion 30 is depressed by pressure of the user's upper lip thereagainst as shown in FIG. 6.

In the embodiment of the invention shown in FIGS. 10 through 14, the central pedestal member 38 is eliminated and the vent hole 39 is provided through the center of the central cover portion 23 of the lid 21.

It should also be noted that in the embodiment of the invention shown in FIGS. 1 through 9, the corrugated buttress member 33 has three parallel spaced-apart ridges 35. On the other hand, in the embodiment of the invention shown in FIGS. 10 through 14, the buttress member 33 has four parallel spaced-apart ridges 35. The number of ridges 34 provided in the buttress member 33 can be selectively varied as desired without altering the scope of this invention. Further, the overall width and height of the corrugated buttress member 33 can be varied as desired. The cut line 31 which defines and forms the tab portion 30 in the lid 21 can also be varied so as to obtain any desired configuration of the tab portion 30 within the central cover portion 23 of the lid 21.

In operation, the non-spill drink-through lid 21 is selectively snap-mounted on any desired drinking cup 22 which contains a liquid 40. As shown in FIG. 6, the annular groove cavity 26 of the lid 21 retainably engages the upper peripheral edge 27 of the cup 22, thereby retaining the lid 21 on the cup 22 as shown in FIG. 6. When the user desires to drink from the cup 22, he raises the cup 22 to his mouth and tilts the cup 22 so that the lid 21 moves into engagement with his lips. As shown in FIG. 6, the upper lip of the user engages the corrugated buttress member 33 and the lower lip of the user engages the annular skirt 24 of the lid 21. As the user's upper lip presses against the corrugated buttress member 33, the tab portion 30 is depressed and the liquid 40 flows through the opening 34 into the mouth of the user.

As shown in FIGS. 6 and 9, the tipping of the cup 22 during the drinking operation causes the liquid 40 (generally hot coffee) to flow against the relatively thin plastic lid 21. In the lids of the prior art, the lip of the user is generally scalded due to hot liquid bearing against the internal surface of the lid. However, the corrugated or other corresponding configuration of the buttress member 33 provides increased surfaces which greatly dissipate the heat of the liquid flowing thereagainst during the drinking operation, thereby eliminating any scalding or other discomfort to the user's upper lip. On occasion, air bubbles 41 are also entrapped within the ridges 35 during the drinking operation, thus further insulating the upper lip of the user from the heat (or cold) of the liquid being consumed.

As previously stated, the elongated annular skirt 24 also engages the lower lip of the user and prevents it from engaging the upper edge surface of the cup, thus also protecting the lower lip of the user from any discomfort due to the temperature of liquid contained in the cup 22.

Figure 5:
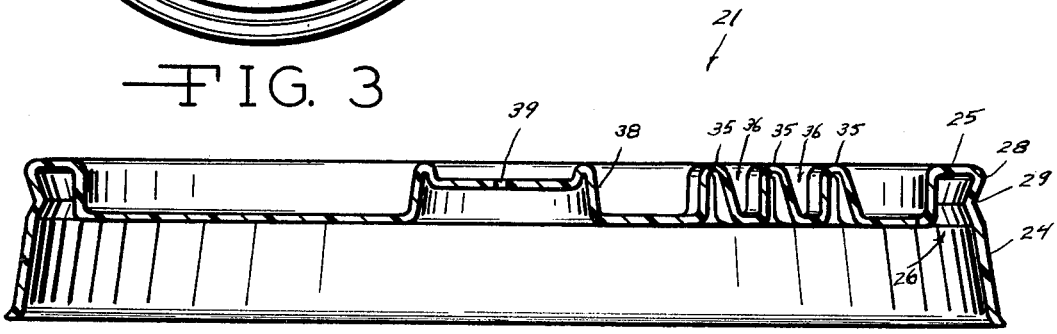
FIG. 5 is a cross-sectional view of the non-spill drink-through lid taken on line 5—5 of FIG. 2.
Figure 14:
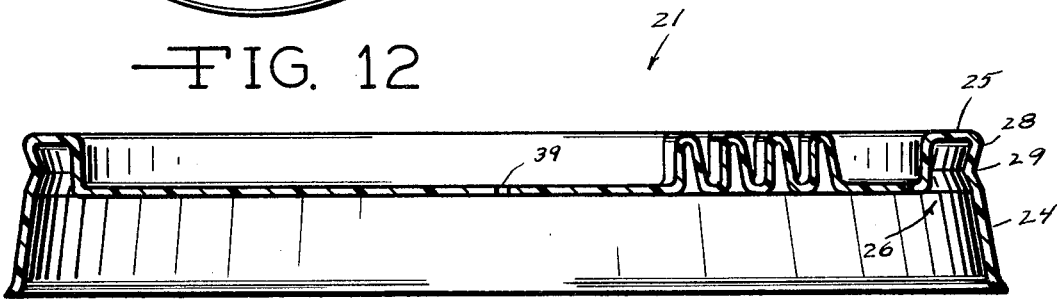
FIG. 14 is a cross-sectional view of the modified embodiment of the non-spill drink-through lid taken on line 14—14 of FIG. 11.

When the user has taken a sip or drink of liquid, he removes the cup 22 from his mouth, thereby removing his upper lip from contact with the buttress member 33. With the pressure thereagainst removed, the tab portion 30 springs back into its normally closed position within the plane of the central cover portion 23 of the lid 21. The corrugated configuration of the buttress member 33 acts to bias the tab portion back into its normally closed position as shown in FIGS. 5 and 14. As the tab portion 30 is pressed downwardly to form the opening 34, the corrugated buttress member 33 is placed under tension which acts to automatically return the tab portion to its normally closed portion when lip pressure thereagainst is removed. This quick-closing action prevents spillage, particularly if the user is taking sips while holding the cup 22 and driving with the other hand.

In summary, a non-spill drink-through lid is provided for use on a drinking cup. The lid has a central cover portion and is adapted to matingly engage the upper peripheral edge of a drinking cup so as to selectively maintain the lid in a covering relationship on the cup. A tab portion is defined in the central cover portion of the lid. The tab portion is selectively depressible so as to provide a drinking opening in the lid. The tab portion is biased so as to selectively return to its normally closed position within the plane of the central cover portion upon removal of pressure thereagainst. A hollow lip-engaging buttress member is integrally formed in the tab portion. The buttress member is configured to provide increased heat-dissipating surfaces thereon so as to insulatively engage the upper lip of a user drinking from the cup through the drinking opening in the lid.

The buttress member has a corrugated configuration comprising a plurality of spaced-apart ridges having corresponding grooves positioned therebetween so as to insulatively engage the upper lip of a user drinking from the cup through the drinking opening in the lid. The buttress member can selectively comprise a plurality of raised portions on the upper surface thereof which define a plurality of corresponding pockets on the bottom surface thereof so as to provide increased heat-dissipating surfaces on the buttress member so as to insulatively engage the upper lip of a user drinking from the cup through the drinking opening in the lid.

Further, the buttress member can also be provided with a plurality of heat-dissipating vane or fin-like surfaces thereon so as to insulatively engage the upper lip of a user drinking from the cup through the drinking opening in the lid.

The buttress member can be selectively configured to extend across the bend line of the tab portion onto the central cover portion so as to enhance the biasing action acting to return the tab portion to its normally closed position within the plane of the central cover portion upon removal of pressure thereagainst.

The lid can also be provided with a downwardly depending outwardly curved elongate annular skirt portion adapted to insulatively engage the lower lip of a user drinking from the cup through the drinking opening in the lid.

It is thus seen that a highly utilitarian non-spill drink-through lid is provided which enables the user to drink from a cup without removing the lid therefrom. The provision of a lip-engaging corrugated buttress member integrally molded on the tab portion of the lid protects the lip of the user by insulating the user's upper lip from the temperature effects of the hot liquid against the lid. The insulating capabilities of the lid are further enhanced by the provision of a downwardly elongate annular skirt on the lid which engages the lower lip of the user so as to prevent contact of the user's lower lip against the wall of the cup containing hot or extremely cold liquid.

Various other modifications of the invention may be made without departing from the principle thereof. Each of the modifications is to be considered as included in the hereinafter appended claims unless these claims by their language expressly provide otherwise.

We claim:

1. A non-spill drink-through lid for use on a drinking cup comprising:

a lid having a central cover portion, said lid adapted to matingly engage the upper peripheral edge of a drinking cup so as to selectively maintain said lid in a covering relationship on said cup;

a tab portion defined in said central cover portion of said lid, said tab portion selectively depressible so as to provide a drinking opening in said lid, said tab portion biased so as to selectively return to its normally closed positon within the plane of said central cover portion upon removal of pressure thereagainst; and a hollow lip-engaging buttress member integrally formed in said tab portion, said buttress member configured to provide increased heat-dissipating surfaces thereon so as to insulatively engage the upper lip of a user drinking from said cup through said drinking opening in said lid, said buttress member having a corrugated configuration comprising a plurality of arcuate narrow spaced-apart ridges having corresponding arcuate grooves positioned therebetween so as to insulatively engage the upper lip of a user drinking from said cup through said drinking opening in said lid, said ridges comprising narrow raised portions which define corresponding pockets on the bottom surfaces thereof so as to provide increased heat-dissipating surfaces on said buttress member so as to insulatively engage the upper lip of a user drinking from said cup through said drinking opening in said lid.

2. In the non-spill drink-through lid of claim 1 wherein said buttress member is selectively configured to extend across the bend line of said tab portion onto said central cover portion so as to enhance the biasing action acting to return said tab portion to its normally closed position within the plane of said central cover portion upon removal of pressure thereagainst.

3. In the non-spill drink-through lid of claim 1 wherein the lid is provided with a downwardly depending outwardly curved elongated annular skirt portion adapted to insulatively engage the lower lip of a user drinking from said cup through said drinking opening in said lid.

* * * * *